US011563264B2

(12) United States Patent
Miura

(10) Patent No.: US 11,563,264 B2
(45) Date of Patent: Jan. 24, 2023

(54) ANTENNA DEVICE

(71) Applicant: Ryutaro Miura, Katagami (JP)

(72) Inventor: Ryutaro Miura, Katagami (JP)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/984,310

(22) Filed: Aug. 4, 2020

(65) Prior Publication Data

US 2021/0050655 A1 Feb. 18, 2021

(30) Foreign Application Priority Data

Aug. 14, 2019 (JP) ..... JP2019-148735

(51) Int. Cl.
*H01Q 1/32* (2006.01)
*H01Q 7/00* (2006.01)
*H01Q 1/48* (2006.01)

(52) U.S. Cl.
CPC ..... *H01Q 1/3275* (2013.01); *H01Q 1/48* (2013.01); *H01Q 7/00* (2013.01)

(58) Field of Classification Search
CPC .. H01Q 1/24; H01Q 1/32; H01Q 1/48; H01Q 5/30; H01Q 7/00
See application file for complete search history.

(56) References Cited

U.S. PATENT DOCUMENTS

| | | | | |
|---|---|---|---|---|
| 10,468,761 | B2 * | 11/2019 | Imamura | H01Q 5/335 |
| 2015/0116167 | A1 * | 4/2015 | Kim | H01Q 9/0407 343/722 |
| 2018/0034153 | A1 * | 2/2018 | Kaneko | H04B 1/00 |
| 2018/0261913 | A1 * | 9/2018 | Imamura | H01Q 1/3275 |
| 2021/0119335 | A1 * | 4/2021 | Mizuno | H01Q 5/307 |
| 2021/0242585 | A1 * | 8/2021 | Yokota | H01Q 1/1214 |

FOREIGN PATENT DOCUMENTS

JP 2018170622 A 11/2018

* cited by examiner

*Primary Examiner* — Hasan Islam
(74) *Attorney, Agent, or Firm* — Holtz, Holtz & Volek PC

(57) ABSTRACT

Disclosed is an antenna device that includes a capacitor element, a first coil, a second coil, and a capacitor. One end of the first coil is connected to a feeding point and another end of the first coil is connected to the capacitor element. One end of the second coil is connected to the capacitor element. One end of the capacitor is connected to the second coil and another end of the capacitor is connected to a grounding point.

6 Claims, 7 Drawing Sheets

ANTENNA DEVICE

CROSS-REFERENCE TO RELATED APPLICATIONS

This application is based upon and claims the benefit of priority from the prior Japanese Patent Application No. 2019-148735, filed on Aug. 14, 2019, the entire contents of which are incorporated herein by reference.

BACKGROUND

Technical Field

The present disclosure relates to an antenna device.

Background Art

A known vehicle-mounted antenna device on the roof of a vehicle, such as a motor vehicle, receives radio waves of a wireless communication system (standard), such as amplitude modulation (AM) radio broadcasts and frequency modulation (FM) radio broadcasts. The AM radio broadcasts employ the medium-wave (MW) frequency band and/or the long-wave (LW) frequency band. The FM radio broadcasts employ the very high frequency (VHF) band. The antenna device is appropriately fixed on the roof of the vehicle. More specifically, a fixing part provided on the bottom surface of the antenna device is inserted into a roof hole for fixing (fixing opening) formed on the mounting surface of the roof.

Vehicle-mounted antenna devices, such as an antenna device in a shark fin shape (shark fin antenna device), have been required to have lower heights. However, a monopole antenna having a lower height has a physically shorter part that contributes radiation. This reduces antenna gain. To increase the antenna gain, which is reduced as a result of lowering the height of the antenna, an antenna may have a folded structure (folded monopole antenna).

A typical folded monopole antenna uses two or more coils one of which feeds electricity and the other of which is grounded, namely shortened. For example, a known antenna device includes an outer side plate for receiving AM radio broadcasts (MW (LW) band) and a folded monopole antenna for receiving FM radio broadcasts (VHF band) (disclosed in JP2018-170622A). The folded monopole antenna includes (i) a first coil one end of which is connected to a feeding point and another end of which is connected to one end of a capacitor plate (capacitor element) and (ii) a second coil one end of which is connected to another end of the capacitor plate and another end of which is grounded.

Further, as an antenna device for receiving signals in the MW (LW) and VHF bands, a known monopole antenna includes a coil and a capacitor plate. One end of the coil is connected to a feeding point and another end of the coil is connected to one end of the capacitor plate. Another end of the capacitor plate is open-ended.

SUMMARY

However, the folded monopole antenna of the antenna device disclosed in JP2018-170622A does not receive signals in the MW (LW) band well because the antenna is grounded. The antenna device includes the separate outer side plate for receiving signals in the MW (LW) band so as to function as a compound antenna for the MW (LW) and VHF bands, as desired for a vehicle-mounted antenna device. This complicates the structure of the antenna device.

The monopole antenna having an open end does not have a folded structure and cannot meet the resonance point to a desired frequency in the VHF band.

The antenna device having the folded monopole antenna also needs a large-sized capacitor plate, which is inappropriate for forming a design-focused antenna device, such as a shark fin antenna device.

Objects of the present disclosure include providing an antenna device having good reception characteristics for multiple frequency bands and a simple and small structure.

To achieve at least one of the above objects, according to an aspect of the present invention, there is provided an antenna device, including: a capacitor element; a first coil one end of which is connected to a feeding point and another end of which is connected to the capacitor element; a second coil one end of which is connected to the capacitor element; and a capacitor one end of which is connected to the second coil and another end of which is connected to a grounding point.

BRIEF DESCRIPTION OF THE DRAWINGS

The accompanying drawings are not intended as a definition of the limits of the invention but illustrate embodiments of the invention, and together with the general description given above and the detailed description of the embodiments given below, serve to explain the principles of the invention, wherein.

DESCRIPTION OF EMBODIMENTS

Hereinafter, one or more embodiments of the present disclosure will be described with reference to the drawings. However, the scope of the invention is not limited to the illustrated examples.

Figure 1:
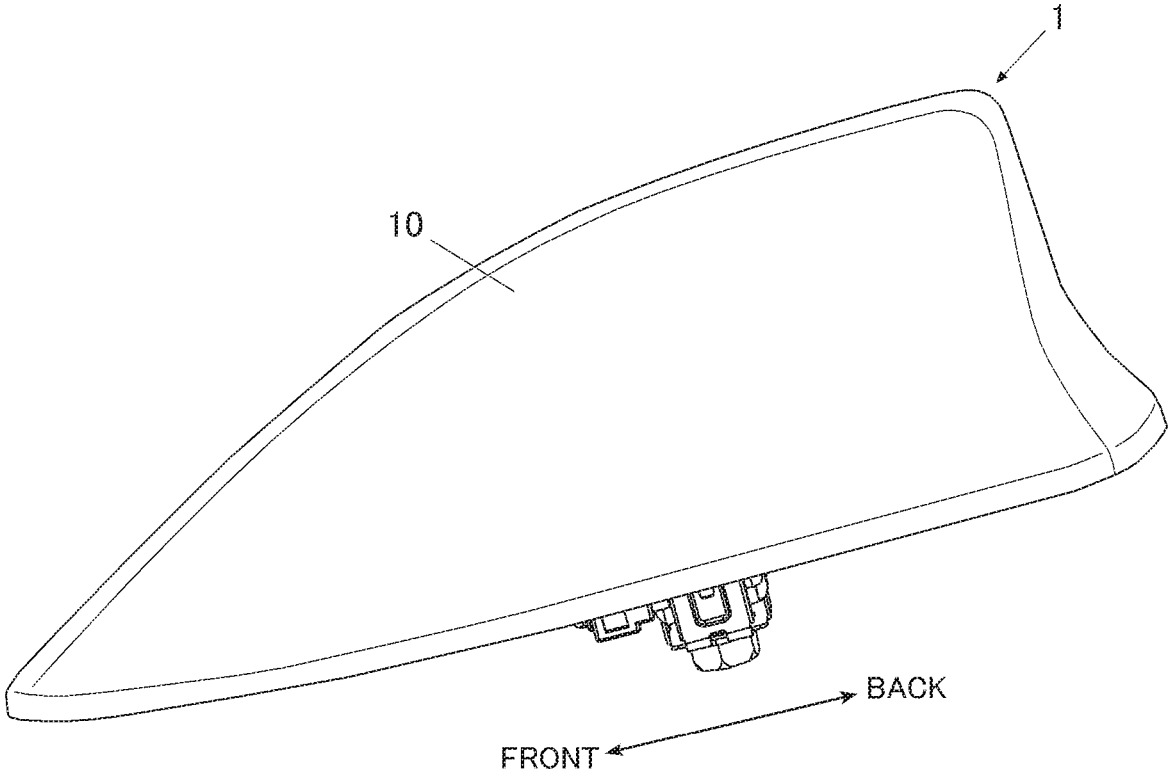
FIG. 1 is a perspective appearance view of an antenna device according to an embodiment of the present disclosure.
Figure 2:
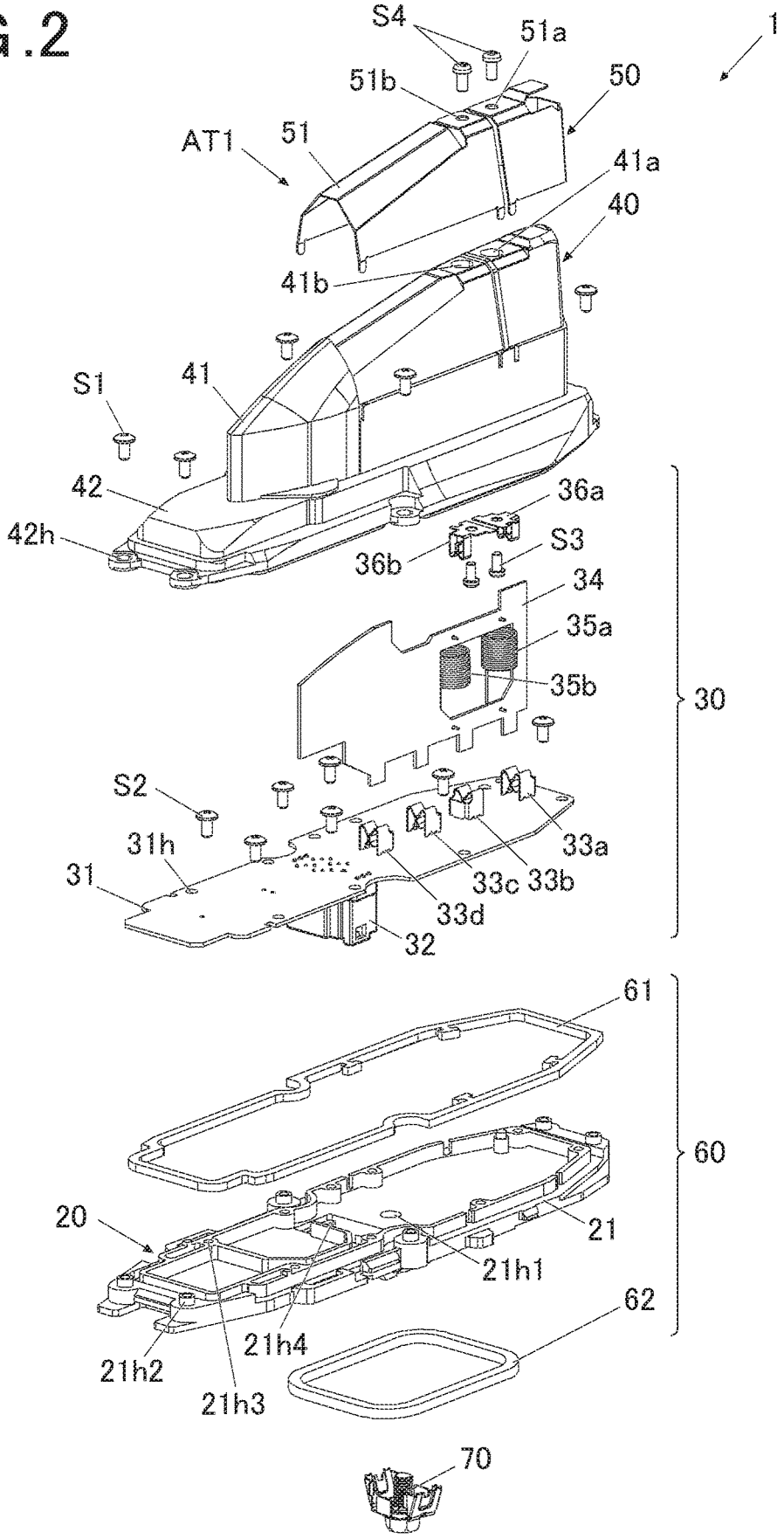
FIG. 2 is an exploded perspective view of the antenna device.
Figure 3:
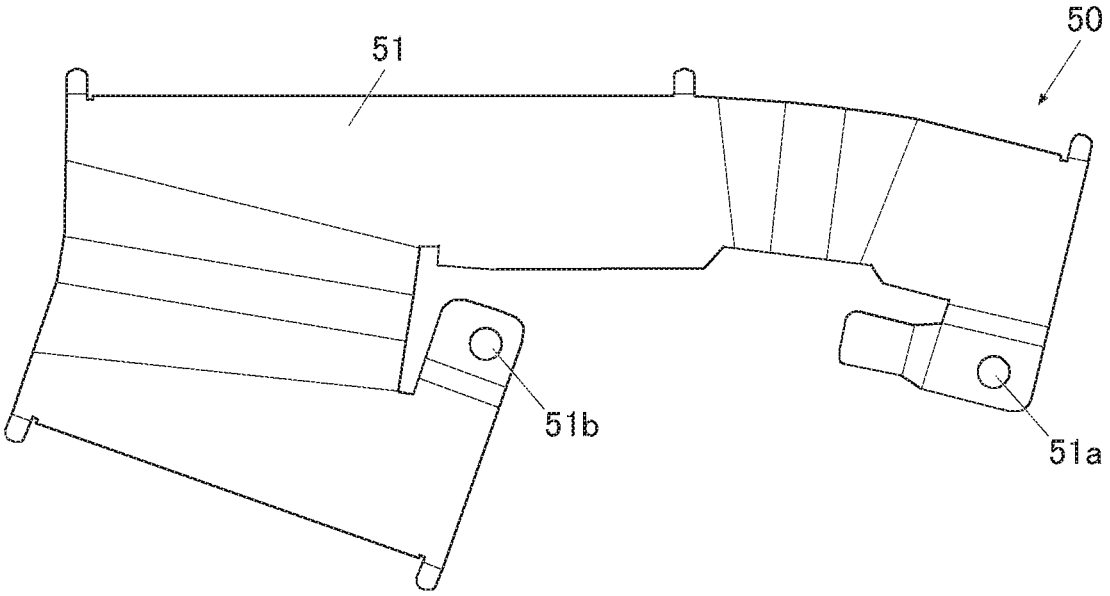
FIG. 3 is a developed view of a capacitor element.
Figure 4:
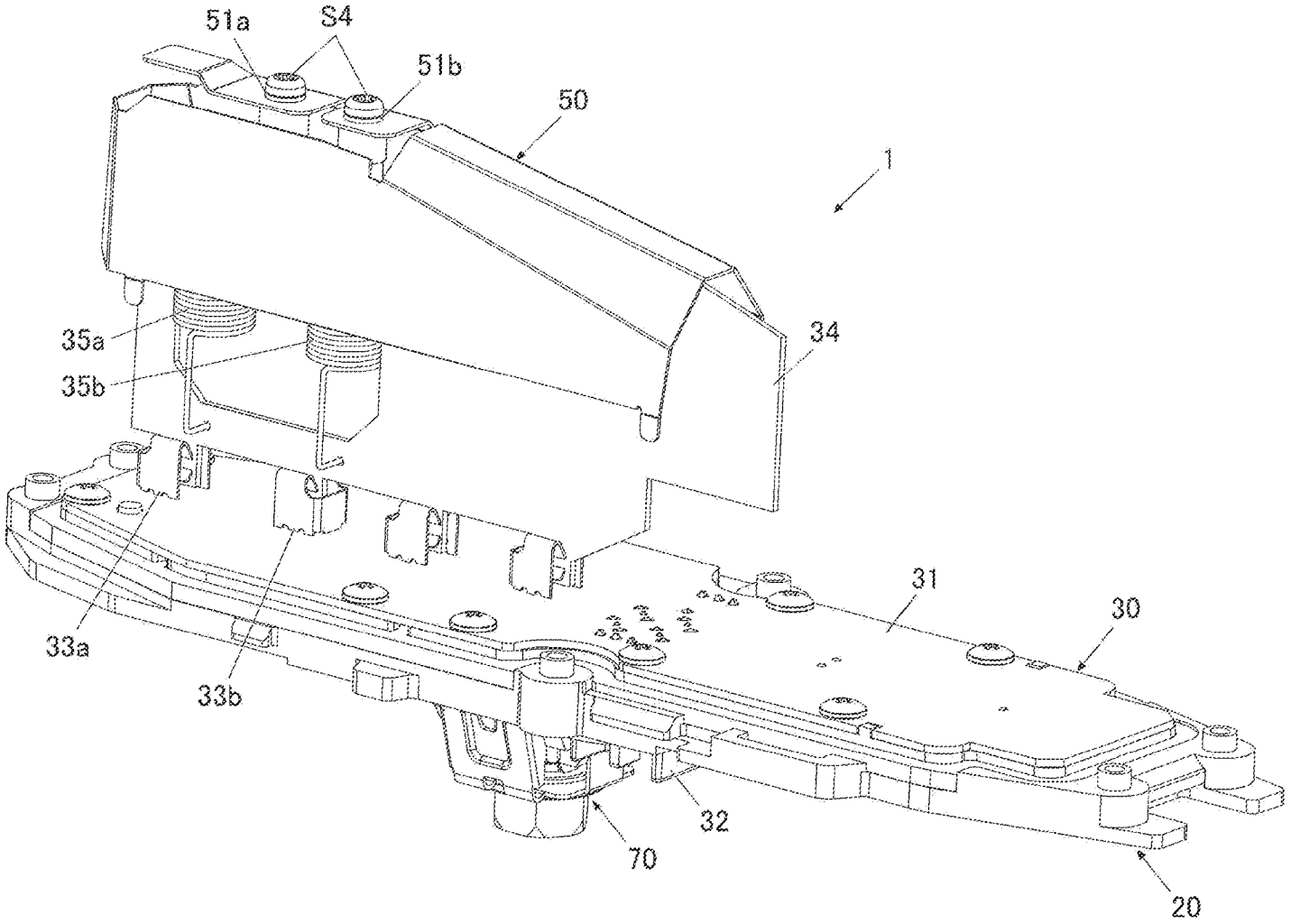
FIG. 4 is a perspective view of the assembled antenna device inside an antenna cover.
Figure 5:
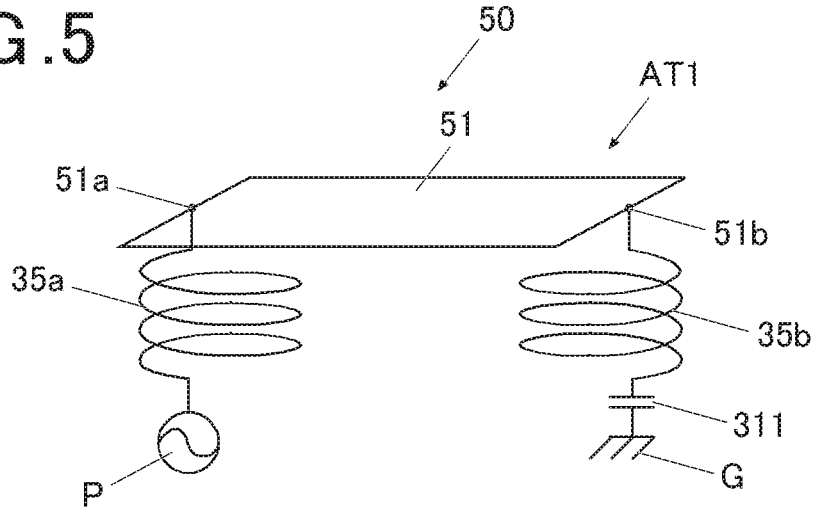
FIG. 5 is a schematic circuit diagram of an antenna.

An antenna device 1 according to an embodiment of the present disclosure is described with reference to FIGS. 1 to 7. FIG. 1 is a perspective appearance view of the antenna device 1 in this embodiment. FIG. 2 is an exploded perspective view of the antenna device 1. FIG. 3 is a developed view of a capacitor element 50. FIG. 4 is a perspective view of the assembled antenna device 1 inside an antenna cover 10. FIG. 5 is a schematic circuit diagram of an antenna AT1.

The antenna device 1 of this embodiment is an antenna device so-called a shark fin antenna that is mounted at the fixing opening (not illustrated) formed on the mounting surface of the roof of a vehicle, such as a motor vehicle. The antenna device 1 is a compound antenna that receives AM radio broadcasts (frequency band: MW (LW) band) and FM radio broadcasts (frequency band: VHF band).

As shown in FIG. 1, the antenna device 1 includes the antenna cover 10 and houses, inside the antenna cover 10, the main body of the antenna. The antenna cover 10 is attached to an antenna base 20, which is described later. The antenna cover 10 is formed to have a streamlined shape rising from the front to the back, or more specifically, formed to have a low-profile shark fin shape so as not to disfigure the vehicle. The antenna cover 10 is a molded part the bottom of which is open. The antenna cover 10 is made of a synthetic resin having radio wave transmissivity and an insulating property, such as Acrylonitrile Butadiene Styrene (ABS) resin.

As shown in the exploded view of the antenna device 1 in FIG. 2, the antenna device 1 includes the antenna cover 10 (not illustrated in FIG. 2), the antenna base 20, a substrate 30, an inner cover 40 as a supporter, a capacitor element 50, a gasket part 60, and a vehicle mounter 70.

The antenna cover 10 forms a space for housing components including the substrate 30, the inner cover 40, and the capacitor element 50, when the antenna base 20 and so forth are attached to the open bottom of the antenna cover 10.

The antenna base 20 is the base of the antenna device 1 and supports the substrate 30. The antenna base 20 has a structure to be attached to the fixing opening formed on the mounting surface of the vehicle. The antenna base 20 includes a plate 21. The plate 21 is a plate-like metal base part made of die-cast aluminum, zinc, or the like. The plate 21 includes screw holes 21*h*1, 21*h*2, 21*h*3, a hole part 21*h*4, and a convex part (not illustrated). The plate 21 may be made of a metal plate(s), such as a steel plate.

The screw hole 21*h*1 is a through-hole as an internal screw hole. An external screw part of the vehicle mounter 70 is screwed on the screw hole 21*h*1 to attach the vehicle mounter 70. The screw hole 21*h*2 is a non-through hole as an internal screw hole. An external screw S1 is screwed on the screw hole 21*h*2 to attach the inner cover 40. The screw hole 21*h*3 is a non-through hole as an internal screw hole. An external screw S2 is screwed on the screw hole 21*h*3 to attach the substrate 30. The convex part (not illustrated) is formed on the underside of the plate 21 to be attached to the vehicle mounter 70.

The substrate 30 includes a main substrate 31, a cable guide 32, connecting terminals 33*a*, 33*b*, 33*c*, and 33*d*, an antenna substrate 34, antenna coils 35*a*, 35*b* as first and second coils, and connecting terminals 36*a*, 36*b*. The main substrate 31 is a printed circuit board (PCB) placed such that its flat surface is in the horizontal direction. On the substrate 31, electronic parts including a capacitor 311 to be described later are mounted to form a circuit pattern. On the top surface of the main substrate 31, connecting terminals 33*a*, 33*b*, 33*c*, and 33*d* are mounted. On the bottom surface of the main substrate 31, the cable guide 32 is mounted. Hole parts 31*h* are also formed on the main substrate 31.

The hole parts 31*h* are through-holes through which screws S2 penetrate. The screws S2 are screwed on the respective screw holes 21*h*3 through the hole parts 31*h*. Thus, the substrate 30 is fixed to the antenna base 20. The capacitor 311, the antenna coils 35*a*, 35*b*, the capacitor element 50, and so forth constitute the antenna AT1 as a folded monopole antenna that receives AM and FM radio broadcasts.

The connecting terminals 33*a*, 33*b*, 33*c*, and 33*d* are M-shaped metal connecting terminals. The connecting terminals 33*a* to 33*d* support and connect to the antenna substrate 34 by holding the antenna substrate 34. The connecting terminal 33*a* is electrically connected to a terminal of a circuit pattern that includes a feeding point P (described later) at the feeding side of the main substrate 31. When connected to the antenna substrate 34, the connecting terminal 33*a* is electrically connected to a terminal of a circuit pattern that is electrically connected to the antenna coil 35*a* of the antenna substrate 34. The connecting terminal 33*b* is electrically connected to a terminal of a circuit pattern that includes the capacitor 311 and a grounding point G (described later) at the grounding side of the main substrate 31. When connected to the antenna substrate 34, the connecting terminal 33*b* is electrically connected to a terminal of a circuit pattern that is electrically connected to the antenna coil 35*b* of the antenna substrate 34. The connecting terminal 33*a* may be electrically connected to the terminal of the circuit pattern at the grounding side, and the connecting terminal 33*b* may be electrically connected to the terminal of the circuit pattern at the feeding side.

The antenna substrate 34 is a PCB erected on the main substrate 31 such that its flat surface is in the vertical direction. The antenna substrate 34 supports the antenna coils 35*a*, 35*b*. On the antenna substrate 34, a circuit pattern that is electrically connected to the antenna coils 35*a*, 35*b* is formed. The antenna substrate 34 includes terminals for the connecting terminals 33*a*, 33*b*, 36*a*, and 36*b*.

The antenna coils 35*a*, 35*b* are distributed constant coils that are wound conducting wires made of enamel-coated copper wires or nickel-coated copper wires, for example. The antenna coils 35*a*, 35*b* may be chip parts and/or lead parts of a lumped constant coil(s) (inductor) mounted on the antenna substrate 34.

The connecting terminals 36*a*, 36*b* are M-shaped metal connecting terminals and support and connect to the antenna substrate 34 by holding the antenna substrate 34. The connecting terminal 36*a* has a hole part for an external screw S3. When connected to the antenna substrate 34, the connecting terminal 36*a* is electrically connected to a terminal of the circuit pattern that is electrically connected to the antenna coil 35*a* of the antenna substrate 34. The connecting terminal 36*b* has a hole part for an external screw S3. When connected to the antenna substrate 34, the connecting terminal 36*b* is electrically connected to a terminal of the circuit pattern that is electrically connected to the antenna coil 35*b* of the antenna substrate 34.

The inner cover 40 is placed inside the antenna cover 10. The inner cover 40 houses the substrate 30 and, as a fixing holder, fixes and supports the capacitor element 50. The capacitor element 50 is not sufficiently fixed to the antenna base 20 only by being connected to the antenna substrate 34 (connecting terminals 36*a*, 46*b*). To deal with this, the inner cover 40 supports the capacitor element 50.

The inner cover 40 includes a dome 41 and a plate 42. Metal parts including screw hole parts 41*a*, 41*b* and resin are integrally molded into the inner cover 40. The dome 41 is made of resin having an insulation property and heat resistance. The dome 41 includes screw hole parts 41*a*, 41*b* and houses therein, as a cover, components including the antenna substrate 34. Examples of the resin having an insulation property and heat resistance include polycarbonate (PC), a mixed material of PC and polyethylene terephthalate (PET), and a mixed material of PC and ABS.

The screw hole part 41*a* is a metal internal screw the axis of which extends in the vertical direction. One of the screws S3 is screwed on the screw hole part 41*a* through the hole part of the connecting terminal 36*a*. One of the external screws S4 is screwed on the screw hole part 41*a* through the hole part 51*a* of the capacitor element 50. The screw hole part 41*b* is a metal internal screw the axis of which extends in the vertical direction. One of the screws S3 is screwed on the screw hole part 41*b* through the hole part of the connecting terminal 36*b*. One of the screws S4 is screwed on the screw hole part 41*b* through the hole part 51*b* of the capacitor element 50.

The screws S3 are screwed on the screw hole parts 41*a*, 41*b* through the hole parts of the connecting terminals 36*a*, 36*b*, respectively. The connecting terminals 36*a*, 36*b* are connected to the antenna substrate 34. Thus, the inner cover 40 is fixed to the substrate 30.

The plate 42 is made of the same kind of resin as the dome 41. The plate 42 as a cover houses therein components including the main substrate 31. The plate 42 includes hole parts 42*h*. The screws S1 are screwed on the screw holes 21*h*2 through the hole parts 42*h*. Thus, the inner cover 40 is fixed to the antenna base 20.

The capacitor element 50 includes a capacitor plate 51. As shown in FIG. 3, the capacitor plate 51 is a metal capacitor plate (metal plate), such as a tinplate. The capacitor plate 51 includes hole parts 51*a*, 51*b*. The capacitor plate 51 is not limited to a metal plate and may be made of a substrate or a conductive resin. Examples of the conductive resin include a resin as a high polymer having electro-conductivity or a resin mixed with fine particles of metals or carbon so as to have electro-conductivity.

The capacitor plate 51 as shown in FIG. 3 is bended at multiple parts into a three-dimensional form as shown in FIG. 2. The capacitor plate 51 functions as a capacitor plate that has a channel(s) of electric currents between the hole parts 51*a*, 51*b*.

The gasket part 60 prevents outside water, dust, and so forth from entering into the vehicle and the antenna device 1 mounted on the roof of the vehicle. The gasket part 60 includes gaskets 61, 62. The gasket 61 is made of an elastic material, such as urethane foam. The gasket 61 is sandwiched and pressed between the antenna base 20 and the inner cover 40 to make the antenna device 1 water-tight and dust-tight. The gasket 62 is made of an elastic material, such as urethane foam. The gasket 62 is sandwiched and pressed between the antenna base 20 and the mounting surface of the roof to make the antenna device 1 water-tight and dust-tight.

The vehicle mounter 70 is made of metal, for example. The vehicle mounter 70 includes (i) an external screw part that forms an external screw and (ii) a leg that contacts the convex part of the antenna base 20 and the mounting surface of the vehicle when mounted on the vehicle. The external screw part of the vehicle mounter 70 is inserted in the fixing opening of the roof and tightened in the screw hole 21*h*1 with the gasket 62 in-between. Thus, the vehicle mounter 70 fixes the antenna device 1 to the mounting surface of the roof of the vehicle.

The components shown in FIG. 2 except for the vehicle mounter 70 are assembled into the antenna device 1 as shown in FIG. 4. The antenna cover 10 and the inner cover 40 are not illustrated in FIG. 4.

As shown in FIG. 5, one end of the antenna coil 35*a* of the antenna AT1 is connected to the feeding point P of the main substrate 31, whereas another end of the antenna coil 35*a* is connected to the hole part 51*a* at one end of the capacitor plate 51 of the capacitor element 50. One end of the antenna coil 35*b* is connected to the hole part 51*b* at another end of the capacitor plate 51, whereas another end of the antenna coil 35*b* is connected to one end of the capacitor 311. Another end of the capacitor 311 is connected to the grounding point G of the main substrate 31, namely grounded/shortened. The capacitor 311 consists of a chip part(s) and/or a lead part(s) of a lumped constant condenser. The capacitor 311 is not limited to a lumped constant condenser. The capacitor 311 may be a distributed constant capacitor, for example, a slit of the main substrate 31.

The antenna AT1 functions as a compound antenna for the MW (LW) and VHF bands by using the capacitor 311.

Figure 6A:
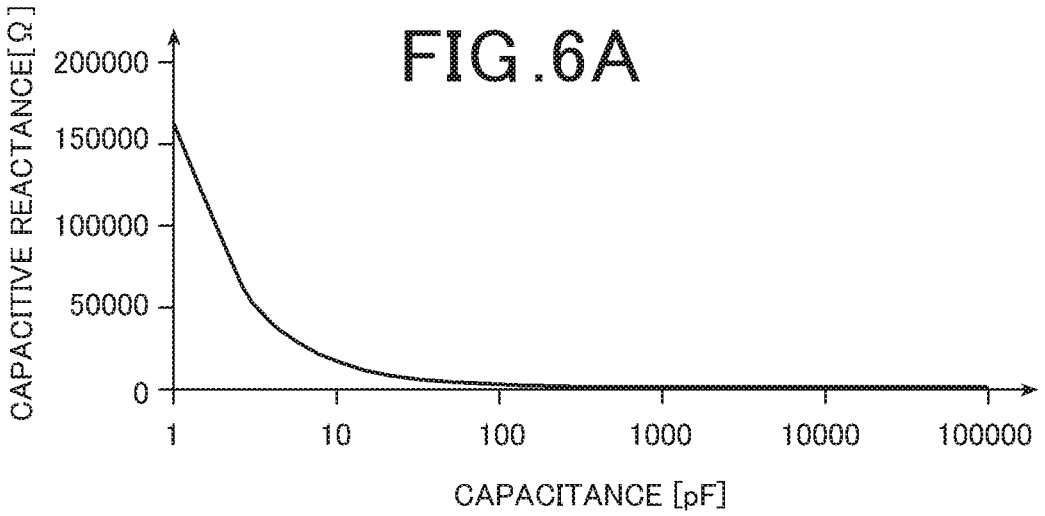
FIG. 6A shows capacitive reactance with respect to capacitance of the antenna for the MW band.
Figure 6B:
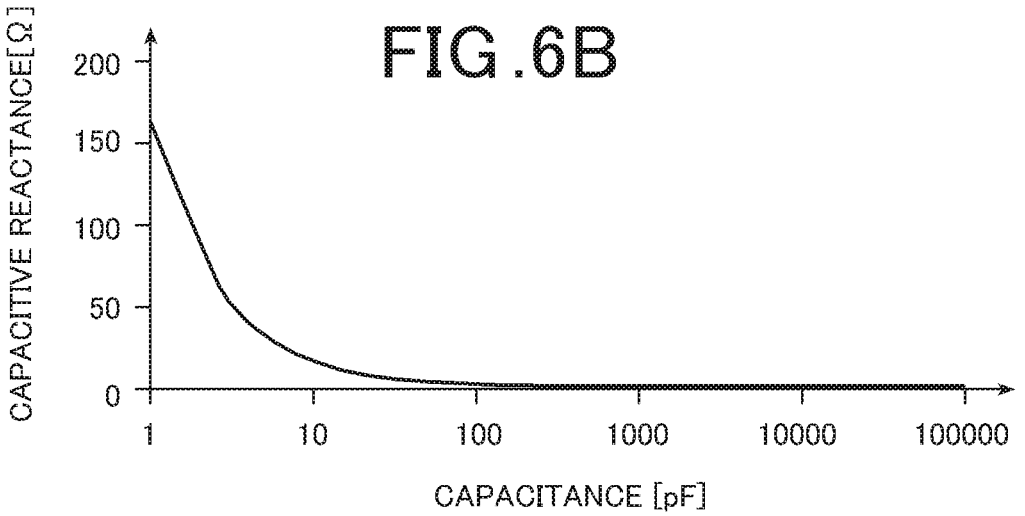
FIG. 6B shows the capacitive reactance with respect to the capacitance of the antenna for the VHF band.

Next, operations of the antenna AT1 are described with reference to FIGS. 6A, 6B. FIG. 6A shows capacitive reactance with respect to capacitance of the capacitor 311 of the antenna AT1 for the MW band. FIG. 6B shows the capacitive reactance with respect to the capacitance of the capacitor 311 of the antenna AT1 for the VHF band.

In the antenna AT1, the antenna coil 35*b* is grounded (shortened) via the capacitor 311. This allows the antenna AT1 to efficiently receive signals in the MW (LW) band without increasing the size of the capacitor element 50. For example, the capacitance of the capacitor 311 and the capacitive reactance are in inverse proportion. The greater the capacitance of the capacitor 311 is, the smaller the capacitive reactance is.

The relation between the capacitance of the capacitor 311 and the capacitive reactance also depends on frequencies. As expressed by the following formula (1), the higher the frequency is, the smaller capacitance of the capacitor 311 is needed for reducing the capacitive reactance.

$$X_C = \frac{1}{2\pi f C} \tag{1}$$

Herein, $X_c$ represents capacitive reactance [Ω], f represents frequency [Hz], and C represents capacitance [F].

FIG. 6A shows the capacitive reactance [Ω] with respect to the capacitance [pF] of the capacitor 311 of the antenna AT1 for the MW (LW) band (1 MHz). FIG. 6B shows the capacitive reactance [Ω] with respect to the capacitance [pF] of the capacitor 311 of the antenna AT1 for the VHF band (98 MHz). With the capacitance of the capacitor 311, the capacitive reactance is large for the MW (LW) band and is small for the VHF band, as shown in FIGS. 6A, 6B. The use of the capacitor 311 allows the antenna AT1 as a compound antenna for the MW (LW) and VHF bands to function as (i) an open-ended monopole antenna for the MW (LW) band and (ii) a folded monopole antenna for the VHF band.

Figure 7A:
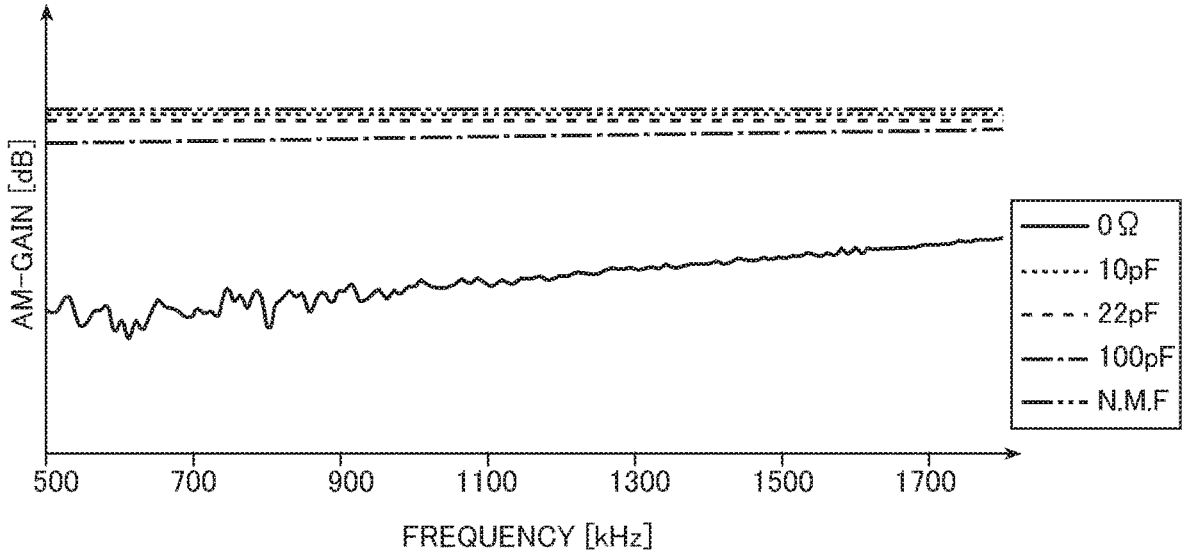
FIG. 7A shows AM gain of the antenna device with respect to frequencies for different amounts of the capacitance of the capacitor.
Figure 7B:
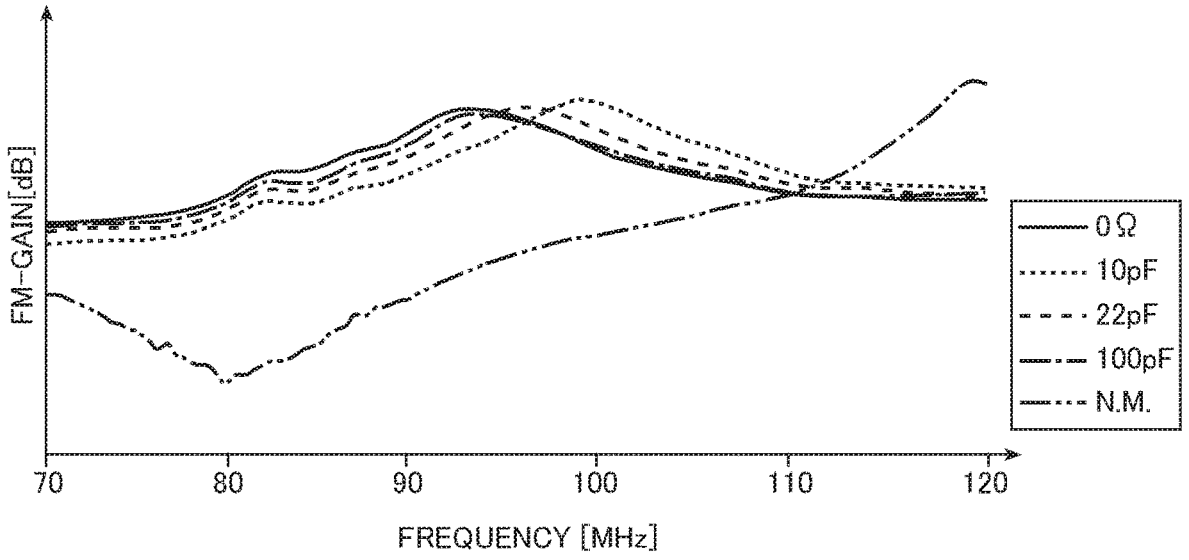
FIG. 7B shows FM gain of the antenna device with respect to frequencies for different amounts of the capacitance of the capacitor.

Next, antenna characteristics of the antenna device 1 are described with reference to FIGS. 7A, 7B. FIG. 7A shows AM gain of the antenna device 1 with respect to frequencies for different amounts of the capacitance of the capacitor 311. FIG. 7B shows FM gain of the antenna device 1 with respect to frequencies for different amounts of the capacitance of the capacitor 311.

With the antenna AT1 constructed as described above, the antenna device 1 can receive signals in the MW (LW) band more efficiently. FIG. 7A shows AM gain of the antenna device 1 with respect to frequencies [kHz]. The AM gain indicates the reception level in the MW (LW) band. The AM gain is measured using different constants (capacitive reactance) with/without the capacitor 311 between the antenna coil 35*b* to be grounded and the grounding point G. N.M. (No Mount) shows a case where the capacitor 311 is absent and the antenna AT1 is open-ended.

FIG. 7A shows that the reception level in the MW (LW) band is highest when the antenna AT1 is completely open-ended (N.M.) and that the reception level decreases as the constant of the capacitor 311 increases. FIG. 7A also shows that the reception level is lowest when the antenna coil 35*b* is grounded without the capacitor 311 in-between (0Ω).

FIG. 7B shows FM gain of the antenna device 1 with respect to frequencies [MHz]. The FM gain indicates the reception level in the VHF band. The FM gain is measured using different constants (capacitive reactance) with/without the capacitor 311 between the antenna coil 35*b* to be grounded and the grounding point G.

According to FIG. 7B, the antenna AT1 cannot form a folded structure in a case of being open-ended (N.M.) and therefore cannot adjust the resonance point to a desired frequency in the VHF band. FIG. 7B also shows that the antenna device 1 has the folded structure only when grounded with or without (0Ω) the capacitor 311 in-between and keeps almost the same reception level, although the resonance point of the antenna device 1 fluctuates owing to the capacitor 311 affected by the inductance of the antenna coil 35*b*.

As described above, the antenna AT1 of the antenna device 1 in the embodiment includes: the capacitor element 50; the antenna coil 35*a* one end of which is connected to the feeding point P and another end of which is connected to the capacitor element 50; the antenna coil 35*b* one end of which is connected to the capacitor element 50; and the capacitor 311 one end of which is connected to the antenna coil 35*b* and another end of which is connected to the grounding point G.

The antenna device 1 can have improved reception characteristics for the MW (LW) band. Further, the antenna device a1 can have improved reception characteristics for the VHF band by adjusting the capacitive reactance of the capacitor 311 and setting the resonance point in the VHF band to a desired frequency. Further, the antenna device 1 has the folded structure without an additional separate antenna element. The antenna device 1 using the capacitor 311 does not need a large-sized element 50. Thus, the antenna device 1 can have a simple and small structure.

Further, the antenna coils 35*a*, 35*b* are a distributed constant coil or a chip part or a lead part of a lumped constant coil. Thus, the antenna coils 35*a*, 35*b* can be appropriately provided.

Further, the capacitor 311 is a distributed constant capacitor or a chip part or a lead part of a lumped constant condenser. Thus, the capacitor 311 can be appropriately provided.

The antenna device 1 further includes the main substrate 31 and the antenna substrate 34. The main substrate 31 includes the feeding point P and the grounding point G. The antenna substrate 34 is erected on the main substrate 31 and electrically connected to the capacitor element 50 and includes the antenna coils 35*a*, 35*b*. Thus, the capacitor element 50 can be provided at a desired position.

The antenna device 1 further includes the inner cover 40 that supports the capacitor element 50. Thus, the capacitor element 50 can be securely fixed and supported at a desired position.

The antenna device 1 further includes the antenna base 20 on which the main substrate and the inner cover 40 are mounted, a vehicle mounter 70 for mounting the antenna base 20 on a vehicle, and the antenna cover 10 having a shark fin shape. Thus, the antenna device 1 can be formed as a shark fin antenna device.

As described above, the present disclosure allows an antenna device to have improved reception characteristics for multiple frequency bands and to have small and simple structure.

The above-described embodiment is an example of the antenna device of the present invention and is not intended to limit the present invention. For example, although the antenna device 1 includes the antenna AT1 that receives AM and FM radio broadcasts, the present invention is not limited to this. The antenna device 1 may include at least one of other types of antennas in addition to the antenna AT1, such as a patch antenna that receives global navigation satellite system (GNSS) signals from GNSS satellites.

Figure 8A:
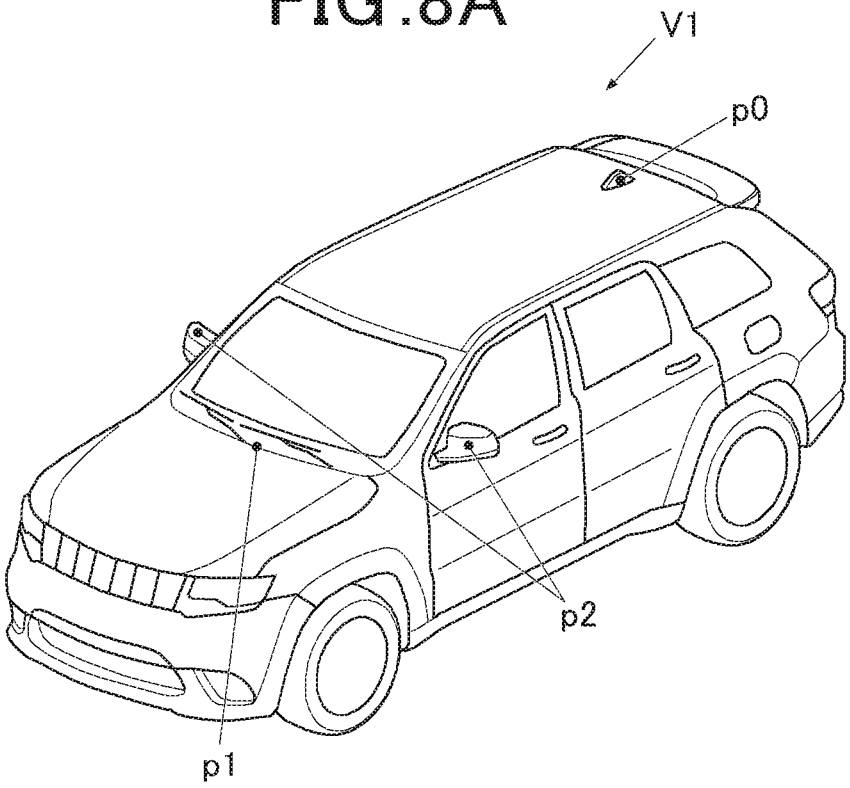
FIG. 8A is a perspective view of the front of an vehicle showing positions where various antenna devices are mountable.
Figure 8B:
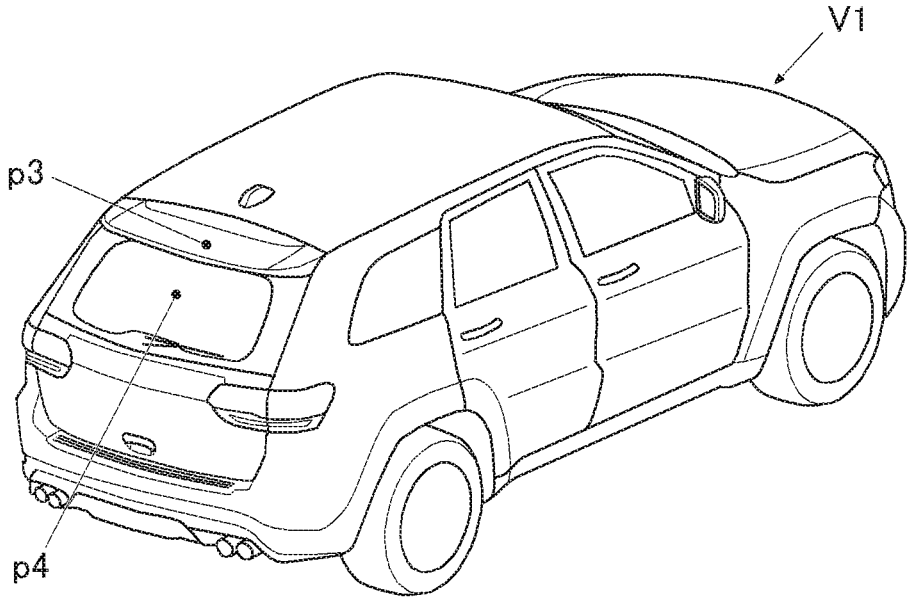
FIG. 8B is a perspective view of the back of the vehicle showing positions where various antenna devices are mountable.

Further, although the antenna device 1 in the above embodiment is a design-focused shark fin antenna, the present invention is not limited to this. FIG. 8A is a perspective view of the front of a vehicle V1 showing positions where various antenna devices are mountable. FIG. 8B is a perspective view of the back of the vehicle V1 showing positions where various antenna devices are mountable.

As shown in FIG. 8A, an antenna device that includes the antenna AT1 having the circuit as shown in FIG. 5 may be, for example, an antenna device including a dashboard-mounted antenna mounted at the position p1 inside the instrument panel (dashboard) or an antenna device including a door-mirror antenna mounted at the position p2 of the door mirror of the vehicle V1, as well as the antenna device 1 mounted at the roof-top position p0 of the vehicle V1. Further, as shown in FIG. 8B, the antenna device including the antenna AT1 may be an antenna device including a spoiler antenna mounted at the position p3 of the rear spoiler of the vehicle V1 or an antenna device including a glass antenna provided at the position p4 of the rear window of the vehicle V1.

Further, although the antenna AT1 of the antenna device 1 in the above embodiment is a compound antenna for the MW (LW) and VHF bands as two frequency bands, the present invention is not limited to this. At least one of the two frequency bands may be any other frequency band, such as the ultra-high frequency (UHF) band.

Further, although the antenna AT1 of the antenna device 1 in the above embodiment is a compound antenna that uses the antenna coils 35*a*, 35*b* and the capacitor 311, the present invention is not limited to this. The antenna AT1 may have multiple circuit parts in each of which the antenna coil 35*b* and the capacitor 311 are connected in series, wherein (i) one end of the antenna coil 35*b* is electrically connected to the capacitor element 50, (ii) one end of the capacitor 311 is electrically connected to the grounding point G, and (iii) the other end of the circuit part is connected to the grounding point to be grounded. The antenna AT1 of the antenna device having the increased number of the antenna coils 35*b* and the capacitors 311 to be grounded (shortened) can be a compound antenna for three or more frequency bands (e.g., MW (LW), VHF, and UHF bands).

The detailed configurations and detailed operations of the antenna device 1 in the above embodiment can also be appropriately modified without departing from the scope of the present invention.

What is claimed is:

1. An antenna device, comprising:

a capacitor plate;

a first coil one end of which is connected to a feeding point and another end of which is connected to the capacitor plate;

a second coil one end of which is connected to the capacitor plate; and only one capacitor, one end of the one capacitor being connected to the second coil, another end of the one capacitor being connected to a grounding point, and the one capacitor having a structure different from the capacitor plate, wherein:

the one capacitor has a capacitance that allows a first value of a capacitive reactance for a first frequency band to be larger than a second value of the capacitive reactance for a second frequency band, the feeding point, the first coil, the capacitor plate, the second coil, the one capacitor, and the grounding point form an antenna, and the antenna is disposed in a cover having a shark fin shape.

2. The antenna device according to claim 1, wherein each of the first coil and the second coil comprises one of (i) a distributed constant coil and (ii) one of a chip part and a lead part of a lumped constant coil.

3. The antenna device according to claim 1, wherein the capacitor comprises one of (i) a distributed constant capacitor and (ii) one of a chip part and a lead part of a lumped constant condenser.

4. The antenna device according to claim 1, further comprising:

a main substrate that includes the feeding point and the grounding point; and an antenna substrate that is erected on the main substrate, that is electrically connected to the capacitor plate, and that includes the first coil and the second coil.

5. The antenna device according to claim 4, further comprising a supporter that supports the capacitor plate.

6. The antenna device according to claim 5, further comprising:

an antenna base on which the main substrate and the supporter are mounted; and a vehicle mounter for mounting the antenna base on a vehicle.

* * * * *